United States Patent [19]

Bowden

[11] Patent Number: 5,015,440

[45] Date of Patent: May 14, 1991

[54] REFRACTORY ALUMINIDES

[75] Inventor: David M. Bowden, St. Louis, Mo.

[73] Assignee: McDonnell Douglas Corporation, St. Louis, Mo.

[21] Appl. No.: 402,852

[22] Filed: Sep. 1, 1989

[51] Int. Cl.[5] ..... G22F 1/00

[52] U.S. Cl. ..... 419/31; 419/26; 419/28; 419/29; 419/45; 419/48; 419/60

[58] Field of Search ..... 419/26, 29, 60, 31, 419/48, 45, 28

[56] References Cited

U.S. PATENT DOCUMENTS 4,762,558 8/1988 German et al. ..... 75/246

*Primary Examiner*—Stephen J. Lechert, Jr.

*Attorney, Agent, or Firm*—Edward H. Renner

[57] ABSTRACT

Light weight refractory aluminides, such as $Al_3Nb$ and related aluminides may be produced from metallic powders by a high temperature exothermic reaction of refractory metals with molten aluminum. Mixtures of refractory metals and aluminum may be prepared and densified by powder metalurgy techniques. Applicant's process permits near net formations of stock shapes and parts by conducting the reaction in situ in a die.

10 Claims, No Drawings

REFRACTORY ALUMINIDES

BACKGROUND AND SUMMARY OF THE INVENTION

The niobium aluminide $Al_3Nb$ has no detectable homogeneity range, is congruently melting, and has the $DO_{22}$ crystal structure similar to $Al_3Ti$. Available information on $Al_3Nb$ concerns its use as an oxidation-resistant coating for niobium-based alloys. Coatings of $Al_3Nb$ can be formed by dipping the niobium alloy into a bath of molten aluminum, which may contain small additions of elements such as chromium and silicon to improve coating performance. The $Al_3Nb$ outer layer provides a thin, protective layer of $Al_2O_3$on the coated substrate.

Because the $Al_3Nb$ phase has a high melting point (above 1600° C.), low density (comparable to that of titanium), and general oxidation resistance, it has potential as a high-temperature structural material. However, its use is severely limited by a lack of ductility because of the $DO_{22}$ crystal structure and the great difficulty in forming the material. Further, the related refractory aluminides such as those of tungsten and tantalum, and the more complex refractory ternary aluminides can be produced to have more favorable crystal structures with improved ductility. These compounds, such as $NbTiAl_3$, $Nb_2Zr_3Al$, and $NbVAl_2$, may also have higher melting temperatures, wider ranges of homogeneity and improved oxidation resistance relative to the binary aluminide phase. These compounds are extremely difficult to produce, however, using conventional casting and solidification processes because of segregation of the various elements. Applicant has found, however, that refractory aluminides can be formed by high temperature direct reaction of aluminum and a refractory metal. This reaction is accomplished at elevated temperatures above the melting point of aluminum. The reaction occurs with the aluminum in the liquid phase and results in the direct formation of the refractory aluminide. The reaction, once initiated is exothermic and proceeds to completion if permitted to sustain. The formed refractory aluminide may be recovered and may be densified by pressure treatment under elevated temperature. Densities of substantially theoretical levels can be achieved. Stock and near net shape parts may be formed by conducting the reaction is a shaped die.

It is thus an object of applicant's invention to provide a process of producing refractory aluminides.

It is a further object of applicant's invention to produce refractory aluminides by direct reaction of aluminum and refractory metals.

It is a further object of applicant's invention to produce refractory aluminides by reacting liquid aluminum with refractory metals.

It is a further object of applicant's invention to produce a dense, homogeneous, single phase $Al_3Nb$ alloy.

DESCRIPTION OF THE PREFERRED EMBODIMENT

Refractory aluminides may be produced by reaction synthesis of powder blends, for example those containing niobium-to-aluminum at about the stoichiometric ratio of 1:3. For the case of material produced using a Nb:Al ratio greater than 1:3, the reaction product is a mixture of $Al_3Nb$ and unreacted Nb as indicated by x-ray diffraction. Reaction of the powder blend containing a niobium-to-aluminum ratio of about 1:3 results in a uniformly-reacted compact. The x-ray diffraction pattern of this material indicates that the reaction has gone to completion, resulting in a single-phase $Al_3Nb$ product. This porous compact can be consolidated to full density by hot isostatic pressing. While this process has been illustrated for the binary niobium-aluminum alloy system, other refractory systems may be used, including the ternary complexes.

The limited ductility of the intermetallic compound $Al_3Nb$ is the major barrier to further development of this alloy as a candidate high-temperature structural material. Poor ductility is a problem in terms of fabrication of useful product forms as well as in determining mechanical behavior. Applicant is able to overcome the problem of ductility by forming stock and near net shapes Further, applicant is able to directly form product by direct reaction between the reactants, without loss of the volatile aluminum.

The intermetallic phase which forms during reaction synthesis is in equilibrium with molten aluminum at the synthesis temperature. For the binary niobium-aluminum system, this aluminide phase is $Al_3Nb$ at synthesis temperatures between about 800° to 1,200° C. preferably about 1000° C. Since the $Al_3Nb$ phase is a line compound with no detectible homogeneity range, care should be taken to properly control stoichiometry. Use of a low-temperature synthesis reaction allows precise control of alloy stoichiometry by avoiding volatilization of the low-melting-point component aluminum, which would tend to occur during conventional melting operations. Uniformity and time of reaction are controlled by the powder characteristics. Large niobium powder particles may result in incomplete reaction, but particle size is not critical. By using smaller, irregularly shaped niobium powder, more complete reaction and uniform microstructure are more easily obtained. The x-ray diffraction pattern of applicant's product disclosed herein indicates that the compact is pure $Al_3Nb$ phase.

EXAMPLE 1

Applicant's process utilizes conventional powder metallurgical processing equipment. The reactant metal powders are of conventional particle size for powder metallurgy processes. The synthesis process utilizes a solid-liquid reaction to synthesize an aluminide intermetallic compound. In this process, the elemental powders are first blended together in the appropriate stoichiometric ratio. To produce the compound $Al_3Nb$, elemental aluminum and niobium powders are blended together in a 3-to-1 atomic ratio. The powder mixture is then placed in a metal can made of a chemically compatible metal (niobium) and degassed by evacuating at a temperature sufficiently high to drive off absorbed gas and moisture from the powder. The can containing the powder mixture is then sealed in vacuum by welding. To synthesize the compound $Al_3Nb$, a pure niobium can is used to prepare the powder pack. The powder pack is then placed in a hot isostatic press unit and heated in argon atmosphere to a temperature sufficiently high to melt the aluminum powder and initiate reaction between the molten aluminum and the solid niobium metal powder (about 1000° C.). This reaction is highly exothermic and proceeds to completion at temperatures between 800°-1200° C., with the reaction proceeding more rapidly at the higher temperatures. The intermetallic compound formed in the binary niobium-aluminum alloy system is the homogeneous phase $Al_3Nb$, which is the niobium aluminide phase in the thermodynamic equilibrium with liquid aluminum at the synthesis temperature Upon completion of the reaction (when one or all of the reactants are consumed), the powder pack (now a porous, aluminide intermetallic compound) is then heated to a temperature sufficiently high to provide for full densification, and argon gas pressure is applied to produce a fully dense compact. The compound $Al_3Nb$ has been produced using the processing parameters of 1400° C. and MPa argon gas pressure for a period of 4 hours, followed by slow cooling and release of pressure in the argon atmosphere. These conditions are effective to produce the product but are not critical. The parameters of the process may be varied around these values. After the compact has cooled, it is removed from the press and the the can is removed by machining or chemical etching. The synthesis process described herein is a two-stage cycle, in which an aluminide intermetallic compound is synthesized by solid-liquid reaction at a lower temperature in the first stage, and a fully dense compact is produced by hot isostatic pressing in the second high temperature and high pressure state. The x-ray diffraction pattern of this material clearly indicates that reaction has resulted in a single-phase niobium aluminide intermetallic compound.

It will be appreciated by those skilled in the art that variations in the invention described herein may be made within the spirit of the invention. The invention is not to be limited to the specific details given herein for purposes of illustration, but rather is to be limited only by the claims appended hereto and their equivalents.

I claim:

1. A method of producing refractory aluminides comprising combining a powdered refractory metal and powdered aluminum in reactive proportions, confining the combined metal powders and heating the combined metal powders to remove entrained gases and moisture, exposing the combined metal powders to a vacuum and sealing the combined metal powders under the vacuum, applying pressure to the sealed confined metal powders and heating the confined metal powders to a temperature above the melting point of aluminum, the temperature being effective to initiate and sustain a reaction between the refractory metal and the aluminum substantially to completion, and recovering the refractorY aluminide.

2. The method of claim 1 including heating the recovered refractory aluminide under temperatures and at pressures effective to substantially fully densify the refractory aluminide.

3. The method of claim 1 wherein the refractory metal is selected from the group consisting of niobium, tungsten and tantalum.

4. The method of claim 1 wherein the refractory metal is niobium.

5. The method of claim 4 wherein the mixed metal powders are heated to between about 800°-1200° C.

6. The method of claim 4 wherein the refractory aluminide is densified at about 1400° C., under about 200 MPa pressure for about 4 hours.

7. The method of claim 4 wherein the mixed metal powders are confined in a niobium container.

8. The method of claim 1 wherein the refractory aluminide is formed as a shaped part.

9. The method of claim 1 wherein the refractory aluminide is formed as a stock shape.

10. The process of claim 1 wherein the composition of the mixture contains other metallic elements.

* * * * *